US005205521A

United States Patent [19]

Smith

[11] Patent Number: 5,205,521

[45] Date of Patent: Apr. 27, 1993

[54] HOSE REEL STAND WITH PIVOT MEANS

[75] Inventor: John H. Smith, Allen Park, Mich.

[73] Assignee: David E. Kafka, Wyandotte, Mich.

[21] Appl. No.: 829,217

[22] Filed: Feb. 3, 1992

[51] Int. Cl.[5] ..... A47G 29/00

[52] U.S. Cl. ..... 248/87; 137/355.27

[58] Field of Search ..... 248/89, 75, 80, 87; 137/355.26, 624.11, 355.27; 239/195, 198, 736, 745

[56] References Cited

U.S. PATENT DOCUMENTS

| | | | |
|---|---|---|---|
| 994,025 | 5/1911 | Montgomery | 137/355.26 X |
| 1,769,342 | 7/1930 | Hall | 239/195 X |
| 3,184,180 | 5/1965 | Rockwell | 242/86 |
| 3,288,306 | 11/1966 | Walters | 248/80 X |
| 4,506,608 | 3/1985 | Garcia | 137/355 |
| 4,793,375 | 12/1988 | Hare | 137/355 |
| 4,807,664 | 2/1989 | Wilson | 137/624.1 |
| 5,060,908 | 10/1991 | Sofy | 248/545 |
| 5,113,627 | 5/1992 | Jarrett | 248/552 X |

FOREIGN PATENT DOCUMENTS

| | | | |
|---|---|---|---|
| 132734 | 2/1976 | Denmark | 239/195 |
| 31334 | 6/1929 | United Kingdom | 137/355.26 |

*Primary Examiner*—J. Franklin Foss
*Attorney, Agent, or Firm*—Robert G. Mentag

[57] ABSTRACT

A hose reel stand having a reel and hub assembly which is rotatable about the vertical axis of the hose reel stand, allowing a hose supported on the reel to be easily dispensed from any direction. The hub is rotatably attached and supported on a post so as to be vertically adjustable. A flow control unit including a valve and flow timer are also attached to the post below the reel and hub assembly. The flow control unit allows complete control of the water flow to the hose so as to provide a complete watering station remote from a water source. The hose reel stand is designed to be permanently anchored to the ground.

20 Claims, 3 Drawing Sheets

HOSE REEL STAND WITH PIVOT MEANS

BACKGROUND OF THE INVENTION

1. Field of the Invention

The present invention generally relates to hose reels for rotatably supporting and dispensing a length of garden hose. More specifically, this invention relates to a hose reel stand for pivotably supporting a hose reel. The hose reel stand permits the hose reel to freely pivot about a vertical axis to facilitate the dispensing of the garden hose from any direction relative to the hose reel stand, while also being adapted to support various flow control devices.

2. Description of the Prior Art

Hose reels are well known in the art for holding and dispensing hoses, such as a common garden hose. An example of a hose reel known in the art is U.S. Pat. No. 4,506,698 to Garcia et al. Typically, the general construction of a hose reel involves some form of hub which can be supported on a mobile stand or attached to a wall, such as an exterior wall of a building. A suitable reel is rotatably mounted to the hub and, in use, a length of hose is wound upon the reel. When desired, the hose can be dispensed by pulling upon the free end of the hose to rotate the reel upon the hub. The reel will often be provided with a handle such that the reel can also be rotated to collect the hose upon the reel.

A disadvantage with hose reel devices such as that taught by Garcia et al is that the method for mounting the hub prevents the hub and reel assembly from adjusting to the direction from which the hose is being pulled. For example, as a result of the hub being mounted to the side of a house or supported by a conventional stand, the hose must either be unwound from the reel by hand or the hose must be pulled in a direction nearly perpendicular to the axis of the hub to encourage the reel to rotate easily. Accordingly, a hose reel assembly as taught by Garcia et al is not particularly suitable for use in a large yard where the user desires to use the hose in several directions relative to the hose reel.

It is known in the art to rotatably support a hose reel upon a post or shaft, as illustrated by U.S. Pat. Nos. 3,184,180 to Rockwell and 4,793,376 to Hare. Rockwell teaches containing the hose reel within a housing which is mounted upon a spike. The spike can be easily inserted and removed from the ground to allow the hose reel's use in various locations. However, the construction of the hose reel assembly taught by Rockwell is not sufficiently rugged for a long length of hose. Moreover, the ease with which the spike can be removed from the ground allows the hose reel assembly to be easily stolen. Hare teaches a more rugged construction, but is limited to providing an enclosed hose reel device which is not readily adjustable or adaptable to meet the various needs of different users. In addition, Hare teaches that the hose and hose reel assembly is rotatably supported with a coupling which can be easily detached, and the hose and reel assembly is therefore also susceptible to theft.

As can be appreciated from the above, it would be desirable to provide a hose and reel assembly that provides ease of dispensing and recoiling the hose, while also having features that make the assembly adjustable and relatively theft-proof.

Accordingly, what is needed is an adjustable hose and reel assembly having a rugged construction adapted to be permanently anchored to discourage theft, while also allowing the hose reel to pivot freely for dispensing the hose in any radial direction from the hose reel.

SUMMARY OF THE INVENTION

According to the present invention there is provided a hose reel stand which is adapted to allow a hose reel to pivot about its vertical axis. Generally, the hose reel stand overcomes the problems associated with mounting a hose reel to the side of the house or other non-rotatable support. Primarily, the hose reel stand provides the additional benefit of being adjustably pivotable so that a user can pull the hose from any direction to dispense the hose from the reel. The stand is also adapted to support various water flow control devices, such as a valve and timing device. An intermediate hose is routed between the flow control devices and the hose reel, from which water flow is provided to the hose through a pipe located within the hose reel. The hose reel is mounted on the stand so as to discourage theft of the hose reel assembly.

The hose reel stand includes an upright support member which is adapted to be anchored permanently in the ground. Slidably disposed upon the support member is a pair of coupling devices which are attached to a hub rotatably supporting the hose reel. The coupling devices allow the hose reel and hub assembly to rotate about the vertical axis of support member. Also provided is a support device which adjustably supports the hose reel and hub assembly along the vertical length of the support ember. Located at or above the hose reel and hub assembly is a suitable locking device which prevents the coupling devices from being removed from the support device so as to prevent the hose reel and hub assembly from being removed.

The flow control devices are also mounted to the support member adjacent the hose reel and hub assembly. The flow control devices provide the advantage of controlling the rate and duration of the water flow to the hose at the hose reel stand member without the need to make adjustments at the water source.

A significant advantage of the present invention is that the hose reel stand is adapted to be permanently and securely anchored in the ground so as to withstand lateral forces exerted as the hose is dispensed from and recoiled onto the hose reel. The permanent anchor also prevents the theft of the hose reel stand.

Another benefit is that the hose reel stand is adapted to support related devices, such as the flow control devices noted above. Such features make the hose reel stand a near self-contained watering station remote from the water source. Due to its uncomplicated construction, the hose reel stand can be readily adapted to support other devices without incurring undesirable manufacturing costs.

Accordingly, it is an object of the present invention to provide a hose reel stand which is adapted to allow a hose reel and hub assembly to rotate about an axis defined by the hose reel stand.

It is a further object of this invention that such the hose reel and hub assembly include a hose reel which is rotatable upon the hub to facilitate dispensing and recoiling of a length of hose.

It is still a further object of this invention that the hose reel and hub assembly be rotatably attached to the hose reel stand in a manner which provides an adjustment feature to allow the height of the hose reel and hub assembly to be adjustable relative to the ground.

It is yet another object of this invention that the hose reel stand be adapted to support flow control and similar devices so as to provide a self-contained unit.

Other objects and advantages of this invention will be more apparent after a reading of the following detailed description taken in conjunction with the drawings provided.

DETAILED DESCRIPTION OF THE PREFERRED EMBODIMENT

Figure 1:
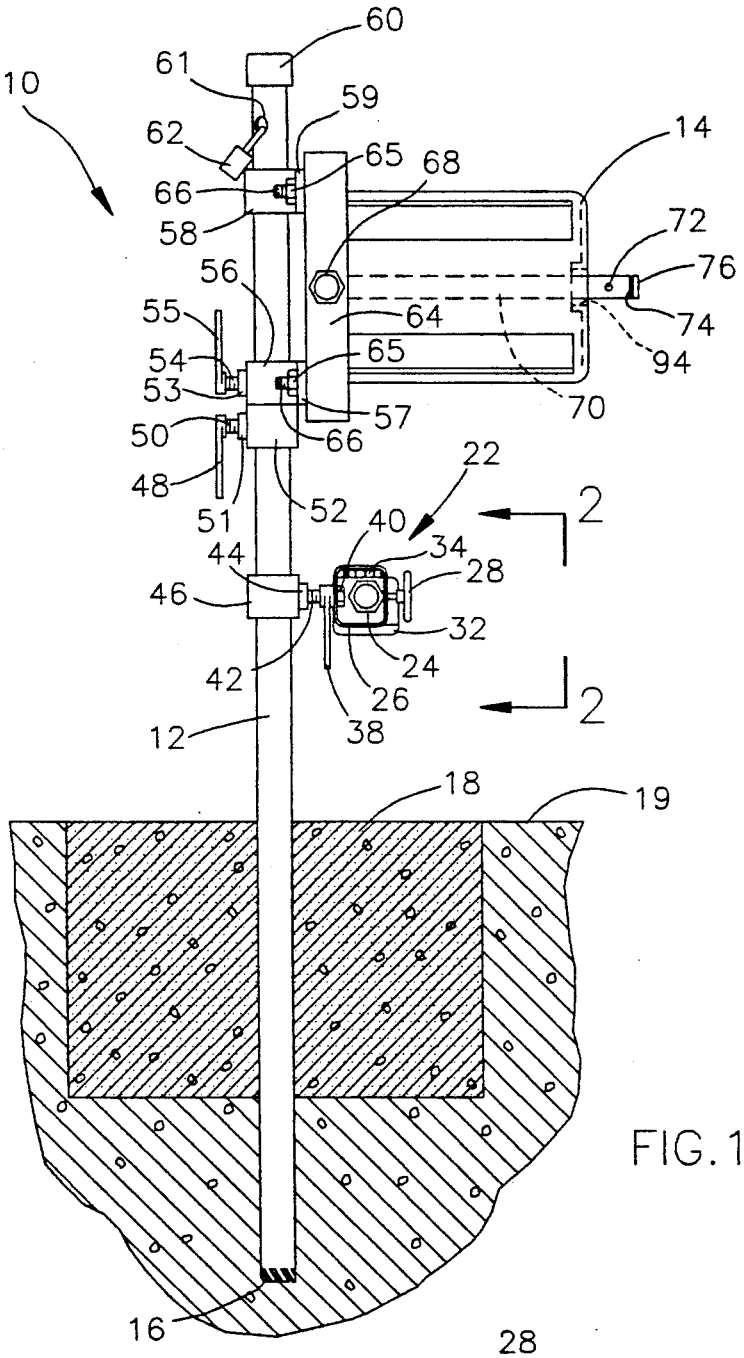
FIG. 1 is a front elevation view of a hose reel stand in accordance with a preferred embodiment of this invention.

FIGS. 1 through 5 illustrate a preferred embodiment of a hose reel stand 10 according to the present invention. The hose reel stand 10 consists of a hub 14 which is mounted on a rigid weather-resistant post 12, such as a metal pipe. The hub 14 can be of any suitable weather-resistant material, though a light-weight material such as a plastic will be generally preferred for purposes of manufacturing costs. The post 12 has a length which is sufficient to allow the hub 14 to be adjusted vertically in a manner to be explained below. A cap 60 is positioned at the top of the post 12 to prevent water from entering the post 12. At the lower end of the post 12 is an annular series of teeth 16 for purposes of aiding in the insertion of the post 12 into the ground 19.

To form a permanent installation for the hose reel stand 10, it is preferred that a circular hole approximately eight inches deep by approximately one foot in diameter is dug. The post 12, with the teeth 16 facing downward, is then set in the center of this hole and rotated to engage the teeth 16 with the soil 19. The teeth 16 act to form a hole into which the post 12 sinks to further anchor the post 12 in the ground 19. When set sufficiently deep, the post 12 is firmly set in place with cement 18 which completely fills the hole.

Figure 5:
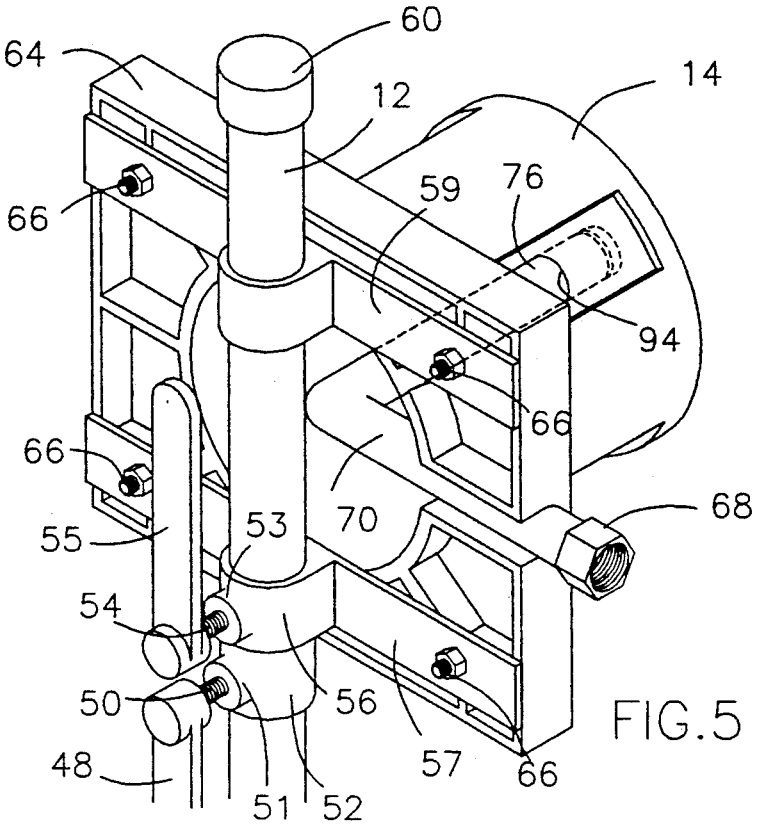
FIG. 5 is a perspective view of the hose reel stand of FIG. 1.

As best seen in FIGS. 1 and 5, the hub 14 is generally tubular-shaped having one or more longitudinal side openings for access to the interior of the hub 14. The hub 14 includes a centrally located flow tube 70 which extends the length of the hub 14 and projects through an opening 94 in the end of the hub 14 opposite the post 12. The flow tube 70 is in fluidic communication with a external female connector 68 mounted to a base 64 at the end of the hub 14 adjacent the post 12. The projecting end of the flow tube 70 has an aperture 72 and an annular groove 74 formed adjacent a closed end 76 of the flow tube 70 for purposes to be explained below.

The base 64 of the hub 14 is attached to a pair of brackets 57 and 59 by corresponding pairs of nuts 65 and bolts 66. The brackets 57 and 59 are coupled to a corresponding pair of support rings 56 and 58, respectively, which serve to slidably mount the hub 14 to the post 12. The lower support ring 56 is provided with a threaded collar 53 into which a fastener 54 is threadably engaged. The fastener 54 includes a handle 55 to lock the hub 14 to the post 12 by engaging the fastener 54 with the post 12. In this manner the lower support ring 56, and thus the hub 14, can be selectively prevented from rotating on the post 12.

Figure 6:
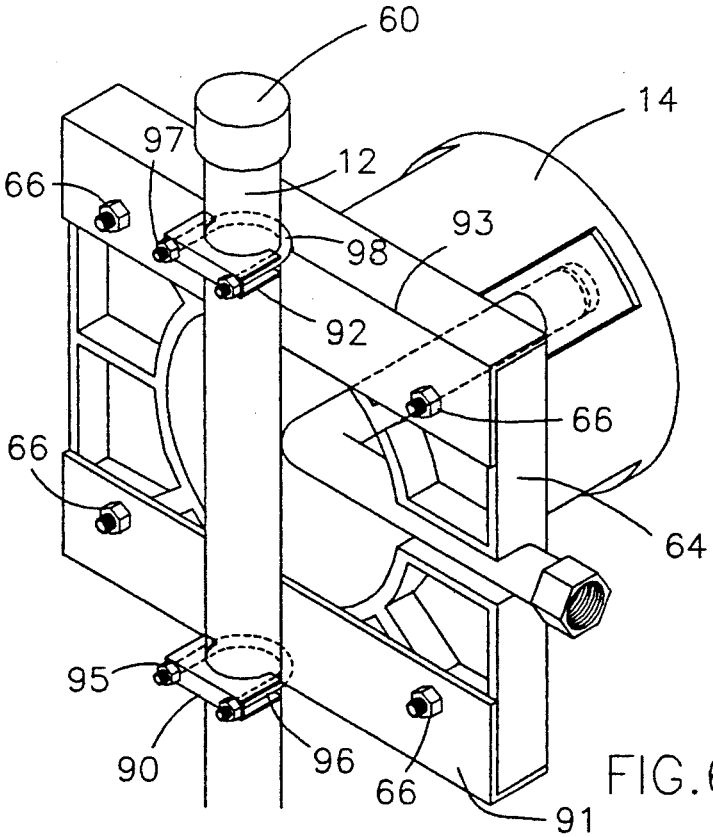
FIG. 6 is an perspective view of the hose reel stand in accordance with a second embodiment of this invention.

In a second embodiment shown in FIG. 6, the base 64 is shown to be attached to the post 12 by a pair of U-shaped brackets 90 and 92. The brackets 90 and 92 include a corresponding pair of threaded U-shaped members 96 and 98, respectively, each being threadably attached to the brackets 90 and 92 by pairs of nuts 95 and 97, respectively. The threaded U-shaped members 96 and 98 are permanently attached to a pair of angle brackets 91 and 93 by any suitable means, such as welding. In turn, the angle brackets 91 and 93 are fastened to the base 64 of the hub 14 by the aforementioned nuts 65 and bolts 66. As noted with the preferred embodiment illustrated in FIGS. 1, 3 and 5, the hub 14 can be selectively prevented from rotating on the post 12 by sufficiently tightening the nuts 95 and 97 upon their respective U-shaped threaded members 96 and 98.

The hub 14 is vertically positioned on the post 12 by a lower clamp ring 52 which has a threaded collar 51, a handle 48 and a fastener 50 similar to that described for the lower support ring 56. The function of the lower clamp ring 52 is to support the hub 14 at a desired height above the ground 19 for the convenience of the user. A lock opening 61 located near the upper end of the post 12 defines the upper limit for the height adjustment of the hub 14. The lock opening 61 allows the use of a lock 62 for preventing the unauthorized removal of the hub 14 from the post 12.

Located immediately beneath the hub 14 is a flow control unit 22 supported by a clamp ring 46 similar to the clamp ring 52 used to support the hub 14. The clamp ring 46 includes a threaded collar 44 which is engaged by one end of a threaded rod 42. A handle 38 is threadably secured adjacent the opposite end of the threaded rod 42, against which is abutted a valve housing 26. A lock nut 40 secures the valve housing 26 to the threaded rod 42. A valve handle 28 extends from the valve housing 26 to provide manual flow adjustment through the valve housing 26. The valve mechanism can be of any suitable design such as those that can be found commercially.

Figure 2:
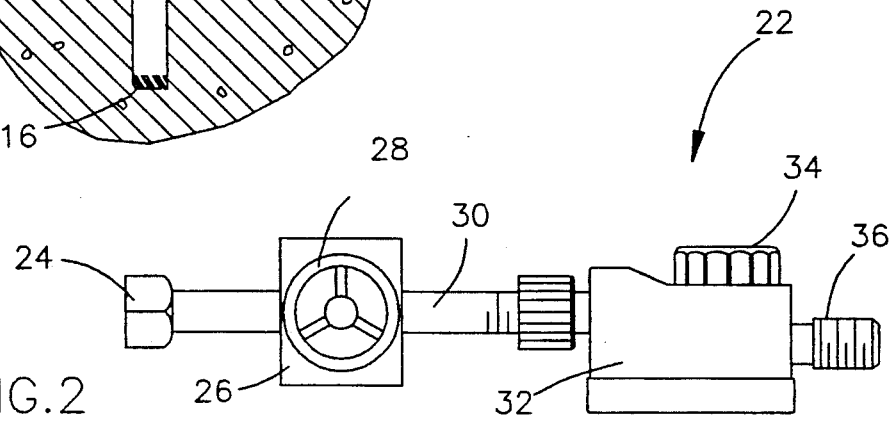
FIG. 2 is a side view of FIG. 1 taken along line 2—2 thereof, and looking in the direction of the arrows.
Figure 3:
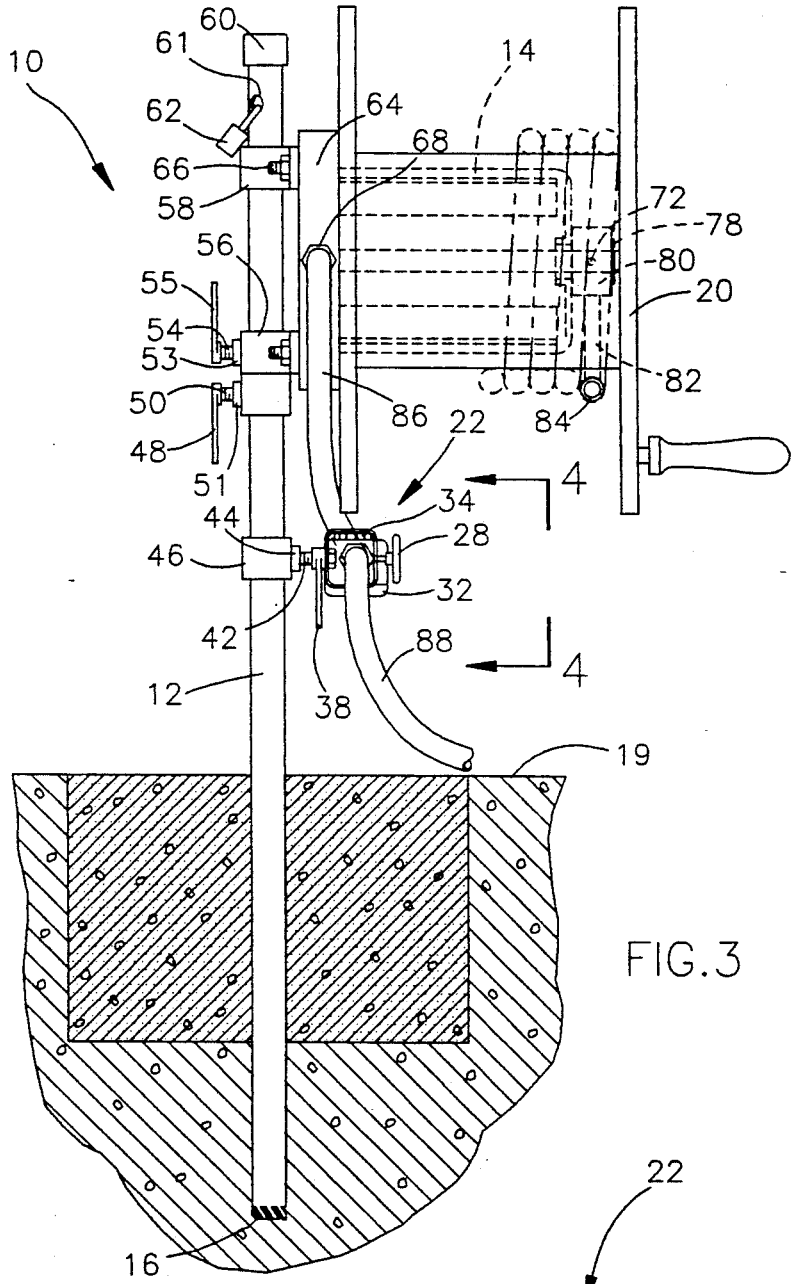
FIG. 3 is a front elevation view of the hose reel stand of FIG. 1 having a hose reel mounted thereto in accordance with a preferred embodiment of this invention.
Figure 4:
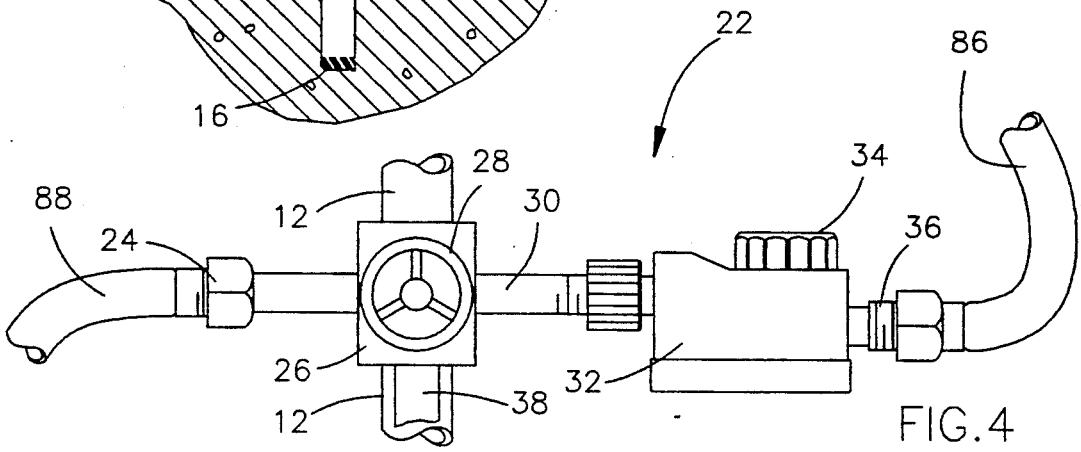
FIG. 4 is a side view of FIG. 3 taken along line 4—4 thereof, and looking in the direction of the arrows.

As best seen in FIGS. 2 and 4, a female connector 24 is attached to one side of the valve housing 26 while a tube 30 projects from the opposite side. A hose 88 attached to a suitable water source (not shown) is threadably attached to the female connector 24 to provide water flow to the valve housing 26. A flow timing device 32 having an adjustment dial 34 is attached to the tube 30, and an outlet is provided on the opposite side of the timing device 32 by a male connector 36. As shown in FIGS. 3 and 4, an intermediate hose 86 extends between the male connector 36 and the female connector 68 mounted to the base 64 of the hub 14.

With further reference to FIG. 3, a reel 20 is positioned over the hub 14 and is rotatably retained by a clip 78 which engages the annular groove 74 formed in the flow tube 70 of the hub 14. The clip 78 also acts to attach a flow collar 80 mounted in the reel 20 to the flow tube 70. The flow collar 80 circumscribes the flow tube 70 at the aperture 72 in the flow tube 70 to form a sealed, but rotatable, flow path. Extending from the flow collar 80 is an integrally-formed radial flow tube 82 which terminates as a male connector 84 near the perimeter of the reel 20. The male connector 84 serves as the water source for a length of hose (as indicated by phantom lines) wound upon the reel 20 in the manner shown.

In use, the hose reel stand 10 serves as a permanent remote watering station for a garden or lawn. The hose 88 connecting the hose reel stand 10 to its water source can be temporarily installed or, if a more permanent installation is desired, underground plumbing can be installed to provide the hose reel stand 10 with a full time water supply. As a result, the flow control unit 22 would serve as the sole flow control for the hose reel stand 10.

Both the flow control unit 22 and the hub 14 can be adjusted to a suitable height for ease of use by operating the corresponding handles 38, 48 and 55. Dispensing of the hose from the reel 20 only requires that the free end of the hose be grasped and pulled in any direction. The hub 14 will automatically correct itself to minimize the effort required to dispense the hose by pivoting upon the post 12 to remain perpendicular to the direction in which the hose is being pulled. Alternatively, the handle 55 can be used to lock the hub 14 in position, which may be desirable when the hose reel stand 10 is not in use.

A significant advantage of the present invention is that the hose reel stand 10 is adapted to be permanently and securely anchored in the ground 19 so as to withstand lateral forces exerted on the post 12 as the hose is dispensed from and recoiled onto the hose reel 20. In addition, the permanency of the hose reel stand 10 allows the user to install permanent buried plumbing to the valve housing 26 if desired, completely eliminating the need to run extra lengths of hose between the water source and the hose reel stand 10. An additional benefit provided by the invention as described is that it is permanently anchored to discourage the theft of the hose reel stand 10.

Another significant advantage is that the hose reel stand 10 is adapted to support devices such as the flow control device 22 described herein. Such a feature make the hose reel stand 10 a near self-contained watering station remote from the water source, including its own flow timer 32 by which water flow can be provided for a predetermined duration. Moreover, due to its uncomplicated construction, the hose reel stand 10 can be readily adapted to support other devices which can be mounted to the post 12 with conventional clamps.

While the invention has been described in terms of a preferred embodiment, it is apparent that other forms could be adopted by one skilled in the art. Accordingly, the scope of the invention is to be limited only by the following claims.

What is claimed is:

1. A hose reel stand (10) for rotatably supporting a hose reel (20) having a length of hose wound thereon, said hose reel stand (10) comprising:
   (a) a support member (12) having a longitudinal axis and a support end for anchoring said support member (12) permanently in the earth;
   (b) means (56,58) for rotatably and removably supporting said hose reel (20) on said support member (12) such that said hose reel (20) is freely rotatable about said longitudinal axis of said support member (12); and,
   (c) means (52) for vertically adjusting the position of said rotatable supporting means (56,58) upon said support member (12).

2. A hose reel stand (10) as claimed in claim 1, further comprising, flow control means (22) mounted on said support member (12) and connected to said length of hose for controlling water flow to said hose.

3. A hose reel stand (10) as claimed in claim 2, wherein, said flow control means (22) includes valve means (26,28) for starting and stopping said water flow to said hose.

4. A hose reel stand (10) as claimed in claim 3, wherein, said flow control means (22) includes timing means (34) connected between said valve means (26,28) and said hose for selectively stopping said water flow to said hose after a predetermined duration.

5. A hose reel stand (10) as claimed in claim 1, further comprising, clamping means (53–56) for selectively preventing said hose reel (20) from freely rotating about said longitudinal axis.

6. A hose reel stand (10) for rotatably supporting a hose reel (20) having a length of hose wound thereon, said hose reel stand (10) comprising:
   (a) support member (12) having a substantially vertical axis and a support end at one end of said vertical axis;
   (b) a hose reel hub (14) for rotatably mounting said hose reel (20) to said support member (12);
   (c) means (56,58) for rotatably and removably mounting said hose reel hub (14) on said support member (12) such that said hose reel hub (14) is freely rotatable about said vertical axis of said support member (12); and,
   (d) means (48,50–52) for supporting, and vertically adjusting the position of, said hose reel hub (14) upon said support member (12).

7. A hose reel stand (10) as claimed in claim 6, further comprising, flow control means (22) mounted on said support member (12) and connected to said length of hose for controlling water flow to said hose.

8. A hose reel stand (10) as claimed in claim 7, wherein, said flow control means (22) includes valve means (26,28) for starting and stopping said water flow to said hose.

9. A hose reel stand (10) as claimed in claim 8, wherein, said flow control means (22) includes timing means (34) connected between said valve means (26,28) and said hose for selectively stopping said water flow to said hose after a predetermined duration.

10. A hose reel stand (10) as claimed in claim 6, further comprising, clamping means (53,54,55) mounted to said rotatable mounting means (56) for selectively preventing said hose reel hub (14) from rotating relative to said vertical axis.

11. A hose reel stand (10) as claimed in claim 6, further comprising, an annular series of teeth (16) disposed at said support end of said support member (12) for aiding in the insertion of said support end into the earth.

12. A hose reel stand (10) for rotatably supporting a hose reel (20) having a length of hose wound thereround, said hose reel stand (10) comprising:
   (a) an elongated support member (12) having a longitudinal axis and a lower support end disposed at one end of said support member (12) for anchoring said elongate support member (12) in the earth;
   (b) a pair of mounting clamps (56,58) and removably rotatably mounted on said support member (12) so as to be freely rotatable about said longitudinal axis of said support member (12);

(c) a hose reel hub (14) attached to said pair of mounting clamps (56,58);

(d) a hose reel (20) rotatably mounted on said hose reel hub (14); and, (e) clamping means (48,50-52) for supporting, and vertically adjusting the position of, said pair of mounting clamps (56,58) upon said support member (12).

13. A hose reel stand (10) as claimed in claim 12, further comprising, flow control means (22) mounted on said support member (12) and connected to said length of hose for controlling water flow to said hose.

14. A hose reel stand (10) as claimed in claim 13, wherein, said flow control means (22) includes valve means (26,28) for starting and stopping said water flow to said hose.

15. A hose reel stand (10 as claimed in claim 14, wherein, said flow control means (22) includes timing means (34) connected between said valve means (26,28) and said hose for selectively stopping said water flow to said hose after a predetermined duration.

16. A hose reel stand (10) as claimed in claim 15, further comprising, an intermediate hose member (86) connected between said timing means (34) of said flow control means (22) and said hose reel hub (14).

17. A hose reel stand (10) as claimed in claim 12, further comprising, clamping means (53,54,55) mounted on one (56) of said mounting clamps for selectively preventing said hose reel hub (14) from rotating relative to said vertical axis.

18. A hose reel stand (10) as claimed in claim 12, further comprising, an annular series of teeth (16) disposed at said support end of said support member (12) for aiding in the insertion of said support end into the earth.

19. A hose reel stand (10) as claimed in claim 12, wherein, said hose reel hub (14) includes passage means (70) for supplying water flow to said length of hose wound on said hose reel (20).

20. A hose reel stand (10) as claimed in claim 12, further comprising, means (61,62) for releasably locking said hose reel hub (14) on said support member (12).

* * * * *